US006866174B2

(12) United States Patent
Hiscocks

(10) Patent No.: US 6,866,174 B2
(45) Date of Patent: Mar. 15, 2005

(54) BABY CARRIER WITH SWIVEL ACTION

(76) Inventor: Catherine Hiscocks, 18 Bridlewood Manor S.W., Calgary, Alberta (CA), T2Y 3T4

( * ) Notice: Subject to any disclaimer, the term of this patent is extended or adjusted under 35 U.S.C. 154(b) by 0 days.

(21) Appl. No.: 10/373,453

(22) Filed: Feb. 24, 2003

(65) Prior Publication Data

US 2004/0164109 A1 Aug. 26, 2004

(51) Int. Cl.[7] ..... A45F 3/00
(52) U.S. Cl. ..... 224/160; 224/159; 224/604
(58) Field of Search ..... 224/159, 160, 224/259, 604, 623, 638, 639, 934; D3/213, 214

(56) References Cited

U.S. PATENT DOCUMENTS

| | | | | |
|---|---|---|---|---|
| 4,139,131 | A | | 2/1979 | Hathaway |
| 4,149,687 | A | | 4/1979 | Nunemacher |
| 4,234,229 | A | * | 11/1980 | Arnold ..... 224/160 |
| 4,724,988 | A | * | 2/1988 | Tucker ..... 224/160 |
| 4,901,898 | A | | 2/1990 | Colombo et al. |
| 4,903,873 | A | | 2/1990 | Poole et al. |
| 4,986,458 | A | | 1/1991 | Linday |
| 5,205,450 | A | | 4/1993 | Derosier |
| 5,246,152 | A | | 9/1993 | Dotseth |
| 5,361,952 | A | | 11/1994 | Gold |
| 5,454,498 | A | * | 10/1995 | Dunn et al. ..... 224/160 |
| 5,522,528 | A | * | 6/1996 | Petricola ..... 224/259 |
| D375,184 | S | * | 11/1996 | Hickli et al. ..... D3/213 |
| 5,692,655 | A | * | 12/1997 | Fair et al. ..... 224/160 |
| 5,813,580 | A | | 9/1998 | Fair |
| 5,848,741 | A | | 12/1998 | Fair |
| D455,546 | S | | 4/2002 | Norman |
| 6,409,060 | B2 | | 6/2002 | Donine |
| 6,415,969 | B1 | | 7/2002 | Higuchi |

* cited by examiner

*Primary Examiner*—Gary E. Elkins
(74) *Attorney, Agent, or Firm*—Gene Scott, Patent Law & Venture Group

(57) ABSTRACT

A baby carrier includes an infant harness and an adult harness joined in sliding engagement enabling horizontal rotation of the infant harness relative to the adult harness. The position of the baby harness may be set at any selected point of rotation. The harnesses are fully adjustable to fit both the baby and the adult and are made of a water compatible material such as that used for swimsuits. The carrier is useful in both pool and shower for supporting the baby safely.

13 Claims, 3 Drawing Sheets

BABY CARRIER WITH SWIVEL ACTION

BACKGROUND OF THE INVENTION

1. Incorporation by Reference

Applicant(s) hereby incorporate herein by reference, any and all U.S. patents, U.S. patent applications, and other documents and printed matter cited or referred to in this application.

2. Field of the Invention

This invention relates generally to baby carriers and more particularly to a baby carrier suitable for use in the pool or shower.

3. Description of Related Art

The following art defines the present state of this field:

Norman, U.S. Des. Pat. No. 455,546 describes an infant carrier design.

Hathaway, U.S. Pat. No. 4,139,131 describes a child carrier comprising an enveloping structure defining a pocket with open top, closed sides and partially closed bottom. A long suspension strap is secured to the enveloping structure at the bottom of the pocket. The strap may be partially padded and has two free end sections for engagement upon an external support. The enveloping structure includes a generally rectangular body which forms sides and back of the pocket, an elongated crotch piece, and a rectangular body piece which forms the front of the pocket. A cross member on the rectangular body has laterally spaced passageways to guide the free end sections of the strap which are then passed around a support and through a loop secured to the bottom of the enveloping structure.

Nunemacher, U.S. Pat. No. 4,149,687 describes a baby pouch, which supports an infant in a position in front of a person wearing the pouch with the latter being supported from the neck of the person. The pouch consists essentially of a fabric back support and a front panel integrally joined to the back support by a neck-like crotch portion. Lateral extensions are integral with the front panel and have end portions formed with detachable fastening elements which are connected after the extensions are wrapped around the back support with the baby positioned on its front. A head rest extends across the upper edge of the back support. A pair of straps are adjustable as to length and each of them has one end secured to the upper end of the back support at one side with the other end having means for adjusting the length of the strap and detachably securing it to the front panel. A neck strap of fixed length has a metallic loop secured to each end with each loop receiving one of the straps of adjustable length and a neck pad is slidably mounted on the neck strap. A pair of adjustable back straps depend from the neck pad so as to extend down the back and around the waist of the person and are detachably coupled to opposite sides of the pouch.

Colombo et al., U.S. Pat. No. 4,901,898 describes an infant carrier adapted to be worn about the waist of an adult for supporting and transporting an infant on the hip of the wearer. According to a preferred embodiment, such carrier comprises a shaped member having first and second contoured portions joined along an arcuate line approximating the waist line of the intended wearer. The first contoured portion is shaped to receive and support the buttocks and legs of an infant who is positioned to face the adult wearer with legs straddling the wearer's waist. The second contoured portion is shaped to the hip region of the wearer. The carrier may also include a belt for securing the shaped member to the wearer's waist. By virtue of its design, the weight of the infant is broadly distributed about the wearer's waist and hip region, thereby avoiding the neck and shoulder strain characteristic of heretofore proposed infant carriers.

Poole et al., U.S. Pat. No. 4,903,873 describes an infant carrier including a harness and a pouch removably secured to the harness. The harness and the pouch are of materials suitable for use in an aqueous environment. The removability of the pouch renders the invention adaptable for interchanging pouches in accordance with the size of the infant to be carried as is desirable, and for replacing harnesses and/or pouches for other reasons as the need may arise from time to time.

Linday, U.S. Pat. No. 4,986,458 describes an infant carrier having an infant supporting pouch and a harness permitting the carrier to be worn by an adult. The harness comprises adjustable shoulder straps and an adjustable girth strap so arranged as to enable the carrying pouch to be switched from a position of frontal support to a position of side support while the harness is on a wearer and while the child remains in the pouch. The carrier may also be used to carry an infant on the back of the wearer.

Derosier, U.S. Pat. No. 5,205,450 describes a carrier for convenient support of a child on an adult in either the facing-in or facing-away position including a waist belt with abdominal support portion, a saddle seat that mounts to the abdominal support portion in either position, an over-the-shoulder harness that attaches at spaced locations on the front of the abdominal support portion, then crisscrosses the back and comes over the shoulder to two narrower vest support straps which clip to portions of the seat. A pocket vest slideably mounts on the vest support straps and a retaining strap laces through the abdominal support portion and the height adjustment loops on the pocket vest.

Dotseth, U.S. Pat. No. 5,246,152 describes a baby carrier designed to be worn by an adult. Principally, the carrier would be worn in front, but it is also adapted for the back or side of the adult. The carrier includes a harness worn by the adult with an attached flap having leg openings for the child's legs. The flap is fixed to the harness at its lower edge and is releasably attached at the upper edge. A head rest for the baby is removably attached to the flap.

Gold, U.S. Pat. No. 5,361,952 describes a soft-type baby carrier for supporting a baby in a rearwardly facing direction on the front or side torso of a wearer. The baby carrier includes an adjustable pouch shaped baby seat for supporting a baby in a substantially upright, sitting position, an adjustable waist belt and an adjustable yoke system for comfortably supporting the baby carrier about the neck of a wearer.

Fair, U.S. Pat. No. 5,813,580 describes a frameless infant carrier, which converts from a front carrier to a hip carrier. The carrier includes a pouch for containing the infant, a waistbelt for adjustably connecting the pouch about the wearer's waist, a pair of shoulder straps attached to the pouch for supporting the infant on the shoulders of the wearer, and a pair of infant support straps connected between the front panel of the pouch and the shoulder straps. The infant support straps are adjustable to provide support for the upper portion of the pouch, and to draw the infant securely against the wearer. The carrier converts between alternate carrying positions by disconnecting each of the shoulder straps from the waistbelt, connecting the free ends of the shoulder straps to the infant support straps, slipping an arm of the wearer under a shoulder strap so that the shoulder strap slips off the shoulder of the wearer, and sliding the pouch laterally around the body of the wearer.

Fair, U.S. Pat. No. 5,848,741 describes a frameless infant carrier, which includes a canopy provided thereon. The carrier also includes a pouch for containing the infant and a pair of shoulder straps attached to the pouch for supporting the infant on the shoulders of the wearer. The canopy is suspended from a position on the pouch behind the infant to central positions on each of the shoulder straps. The canopy may be composed of a breathable, mesh material and may be selectively attachable to and removable from the shoulder straps via buckles. A pocket is defined in the back of the pouch to contain and store the canopy when not in use.

Donine, U.S. Pat. No. 6,409,060 describes an improved child carrier capable of carrying both infants and larger toddlers. The device features a removable infant seat insert to accommodate the seating requirements of smaller infants in the larger seat panel. The infant seat insert may either be removably attached to the device or in an alternate embodiment is deployable from a pocket formed in the body support panel. The carrier also features a strapping arrangement that allows lateral translation of the shoulder straps to aid in comfort during use and an arrangement at the waist band to keep the seat of the device generally upright when the wearer bends forward.

Higuchi, U.S. Pat. No. 6,415,969 describes a baby carrier having a pad of the present invention comprises a carrier body including at least a back rest and capable of accommodating and holding a baby in both a face-to-face holding manner in which the baby is held such that the back rest is brought into contact with a back of the baby and a forward-facing holding manner in which the baby is held such that the back rest is brought into contact with chest and abdomen of the baby; and shoulder belts and mounted to the carrier body and carried on left and right shoulders; wherein the baby carrier further comprises a pad, which can cover the back rest, mounted detachably in the carrier body, formed wider than a portion which corresponds to a crotch rest portion of the back rest of the carrier body when the carrier body is used in the forward-facing holding. With this structure, it is possible to safely and comfortably hold the baby in any of the face-to-face and forward-facing directions, and to carry the baby laterally and piggyback.

The prior art teaches infant and child carriers, and baby pouches of various configurations and types for carrying a child at the front, back and side of an adult, but does not teach such a device having the ability to turn the child relative to the adult so as to provide an improved ability of the child to be sheltered from a danger on one side or the other and to allow the child added freedom of movement. The present invention fulfills these needs and provides further related advantages as described in the following summary.

SUMMARY OF THE INVENTION

The present invention teaches certain benefits in construction and use which give rise to the objectives described below.

The present invention is a baby carrier which includes an infant harness with built in aid to flotation and an adult harness joined in sliding engagement enabling horizontal rotation of the infant harness relative to the adult harness. The position of the baby harness may be set at any selected point of rotation and by friction will remain in that position until readjusted and is designed to carry the baby in the front facing position. The harnesses are each fully adjustable so as to fit a range of individuals. Both are made of a water compatible material such as that used for swimsuits. The carrier is useful in both pool and shower for supporting the baby safely.

A primary objective of the present invention is to provide an apparatus and method of use of such apparatus that provides advantages not taught by the prior art.

Another objective is to provide such an invention capable of supporting a baby with an adult while in a shower and to provide added buoyancy to the baby when used with an adult in the pool, thereby reducing weight and strain on the adult's shoulder and neck.

A further objective is to provide such an invention capable of adjusting over a range of sizes.

A still further objective is to provide such an invention capable of comfortable use for extended periods of time by distributing the baby's weight over the adult's neck, shoulders, back and waist, while reducing friction from seams rubbing on skin surfaces and risk of seams separating due to washing or wear and tear over time.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
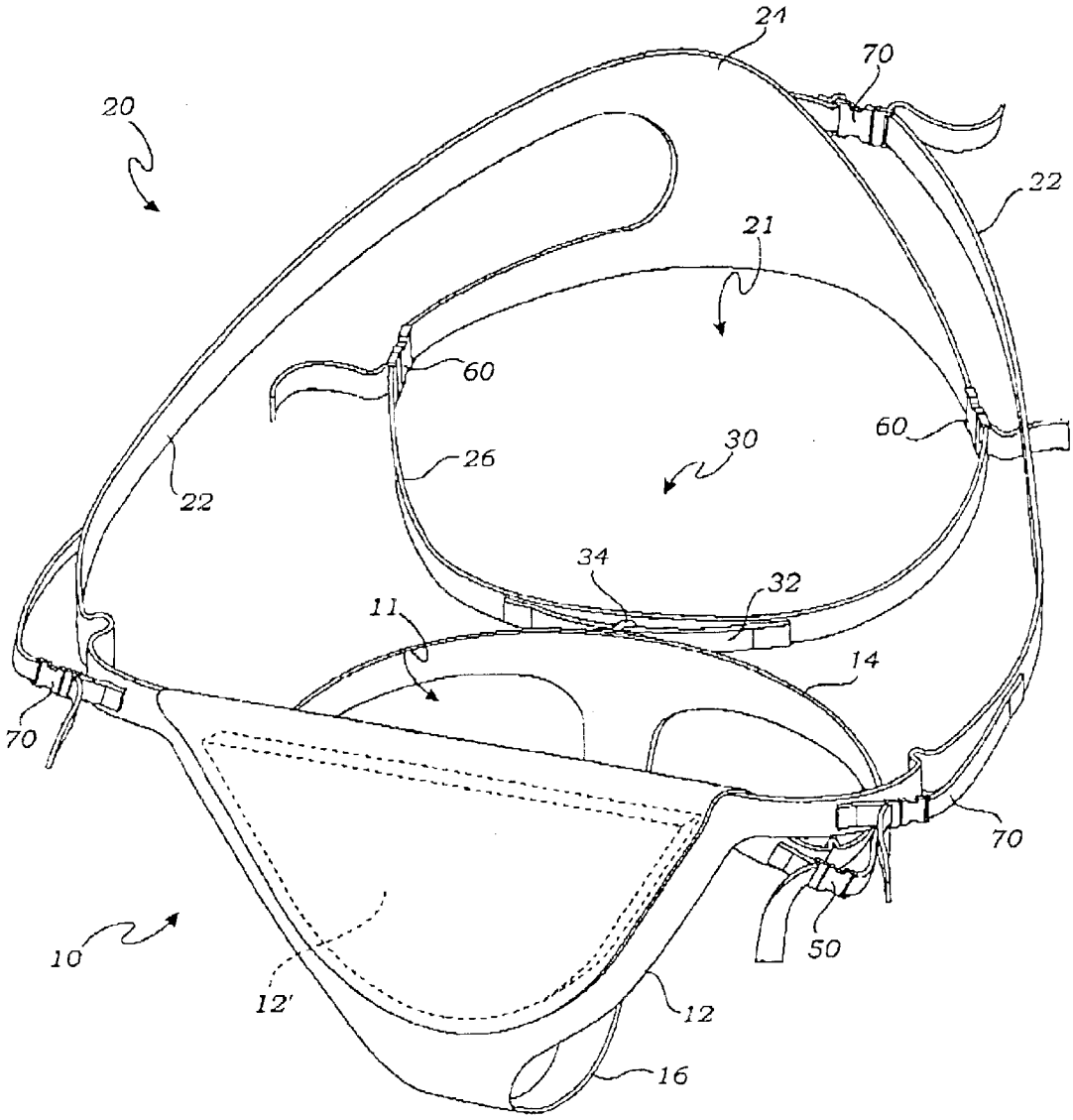
FIG. 1 is a perspective view of the preferred embodiment of the invention.
Figure 2:
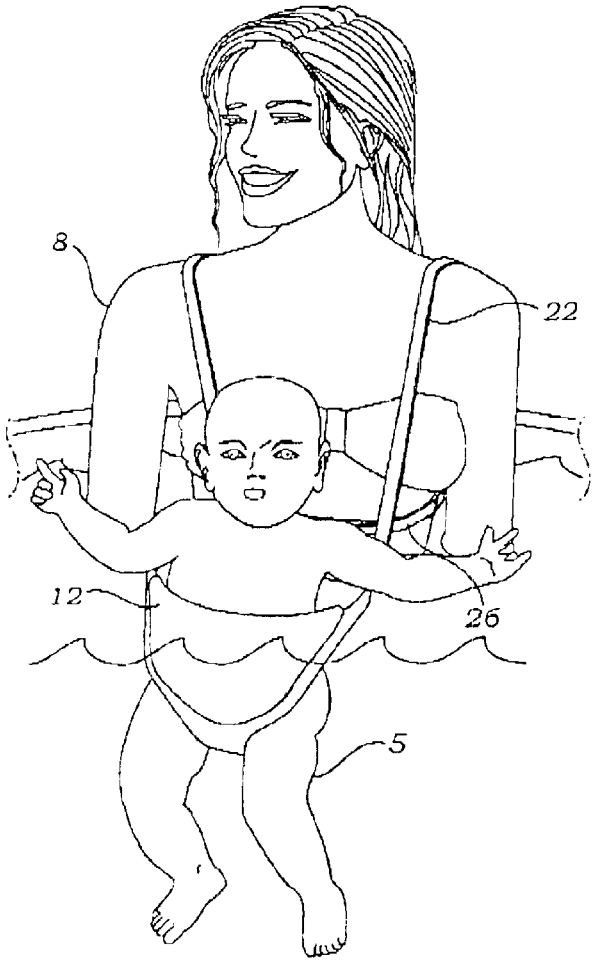
FIGS. 2 and 3 are front elevational views thereof showing the invention in use in a pool environment and in a shower respectively.
Figure 3:
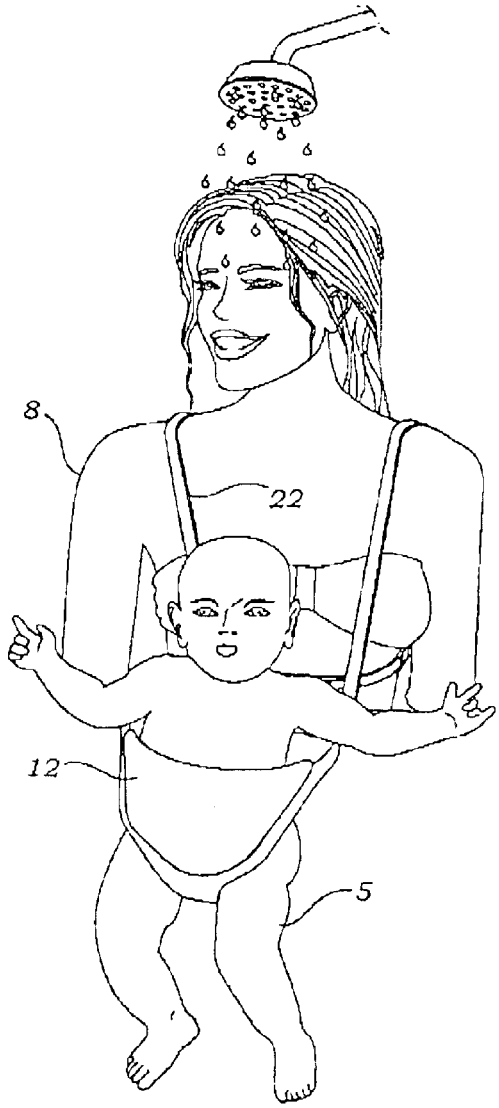
Figure 4:
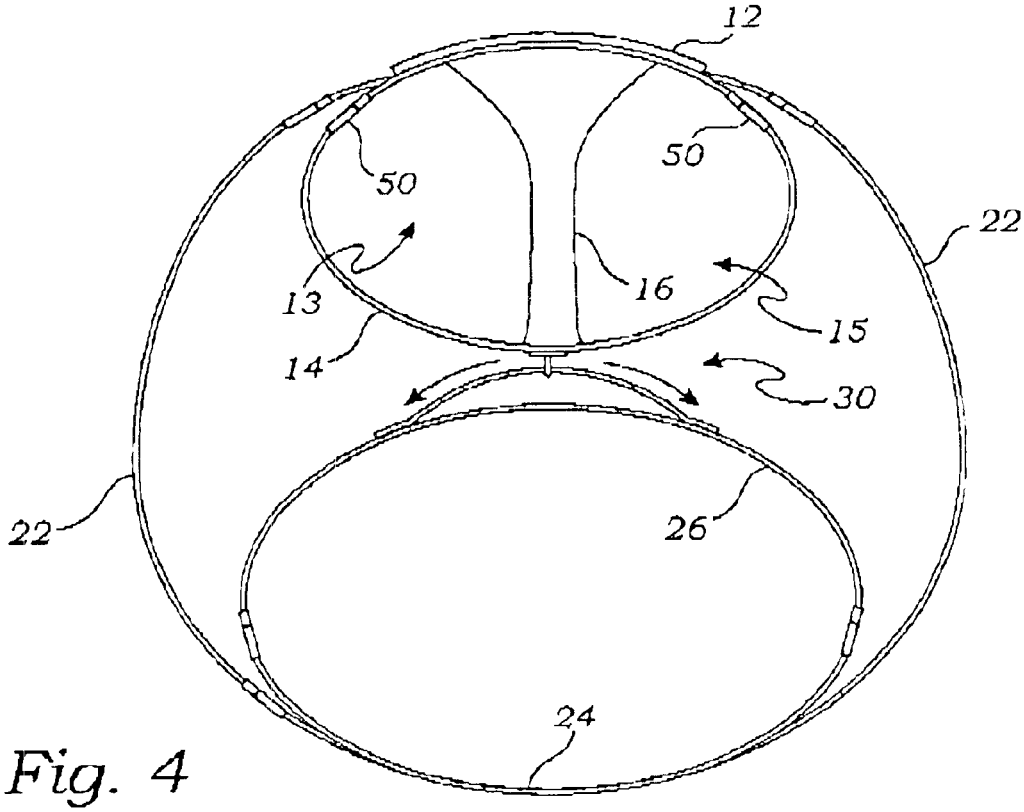
FIGS. 4 and 5 are top plan views thereof showing rotational movement of a baby harness portion of the invention relative to an adult portion.
Figure 5:
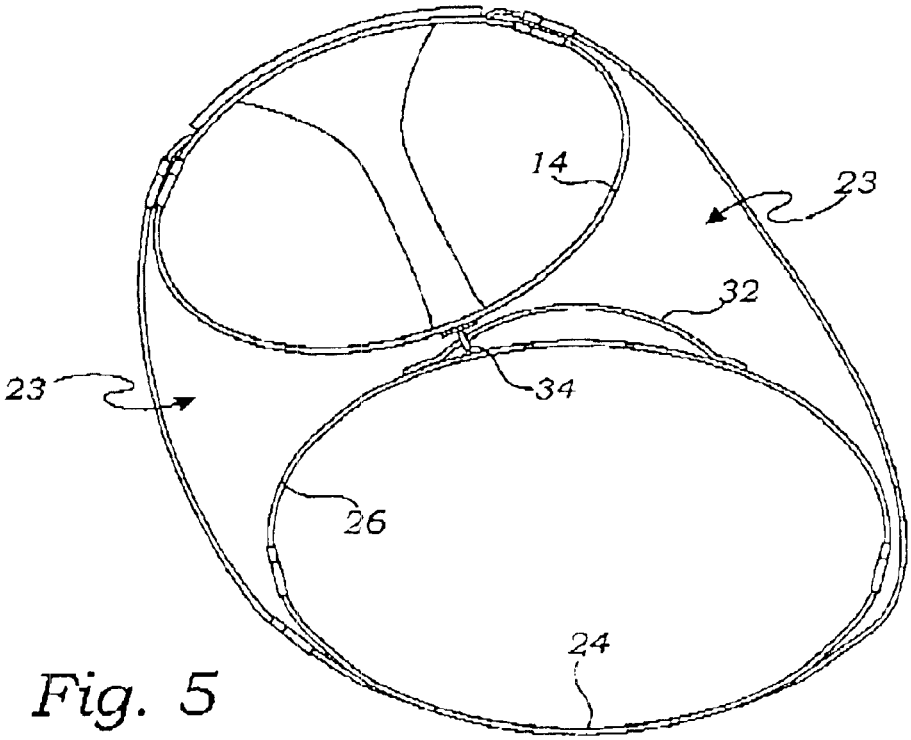

The present invention is a baby carrier apparatus comprising in combination; an infant or baby harness 10; an adult harness 20; and a means for sliding engagement 30 between the infant and adult harnesses 10, 20. The sliding engagement means 30 enables horizontal rotation of the infant harness 10, as shown in FIGS. 4 and 5, so that an infant or baby 5 has the additional freedom of being able to twist and turn while in the safety of the harness 10 and may be turned away from danger on one side or the other of the adult 8. The baby 5 is carried frontally with respect to the adult 10 and preferably the baby 5 faces away from the adult 8 as is shown in FIGS. 2 and 3, but the baby may be faced toward the adult if necessary by using a raised shoehorn shaped frontal panel (not shown) to provide neck and back support to a baby facing inward. The infant harness 10 provides fabric frontal 12, rear 14 and crotch 16 panels configured with an baby waist aperture 11 and two leg apertures 13, 15 for accepting the baby 5 within the infant harness 10 as shown. The frontal panel 12 contains flotation material 12' such as a Styrofoam® panel or the equivalent, to improve the general buoyancy of the baby when the apparatus is used in a pool, and also to function as a cushion and to help hold the shape of the baby crotch panel 16. A means for baby waist and leg cinching 50 of the baby waist aperture 11 and the baby leg apertures 13, 15 for tightening and also loosening the infant harness 10 about the baby 5 is provided to enable a relatively snug and comfortable fit. Such cinching means 50 may be any common strap length adjustment device as is well known in the art.

The adult harness 20 provides fabric shoulder straps 22, preferably padded for comfort, that are part of the one back panel 24, and a waist strap 26 configured with an open adult waist aperture 21 and two arm apertures 23 for accepting an adult 8 within the adult harness 20. A means for adult waist cinching 60 of the adult waist aperture 21 is provided for tightening the adult harness 20 about the adult 8. A means for adult shoulder cinching 70 of the arm apertures 23 for tightening the adult harness 20 about the adult 8 is provided. Shoulder cinching also adds strength and reinforcement through strapping for heavier babies. Adult shoulder strap cinching means 80 is attached to the one piece shoulder straps and back panel 24 and is an additional way of raising or lowering baby 5 relative to adult 8, and clips in the left shoulder strap as shown. Such cinching means 60, 70 and 80, again may be any strap length adjustment device known in the art. It should be noted that adjustment of the cinching means 70 or 80 also has the effect of adjusting the height of the infant harness 10 relative to the adult harness 20.

The sliding engagement means 30 provides frictional contact enabling horizontal positional setting of the infant harness 10 with respect to the adult harness 20. This is accomplished by using an engagement strap 32 which slides within a buckle 34, wherein the buckle 34 provides a tight fit for the engagement strap 32. Alternately, the friction may be light or removed entirely for free rotation over a limited range defined by the length of strap 32. Such frictional adjustment may be accomplished by adjusting the relative sizes of strap 32 and buckle 34.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A baby carrier apparatus comprising in combination: an infant harness providing a rear panel with a buckle extending outwardly therefrom; and in adjacency thereto, an adult harness providing a waist strap, and an engagement strap having opposing ends, the engagement strap fixed at the opposing ends thereof to the waist strap: the engagement strap slidably engaged within the buckle, thereby providing sliding motion between the infant and adult harnesses enabling horizontal rotation of the infant harness relative to the adult harness as the buckle is moved along the engagement strap.

2. The apparatus of claim 1 wherein the infant harness provides fabric front, rear and crotch panels configured with an open waist aperture and two leg apertures for accepting a baby within the infant harness, the front panel containing a flotation material for providing buoyancy.

3. The apparatus of claim 2 wherein the flotation material is Styrofoam®.

4. The apparatus of claim 2 further comprising means for adjustment of the baby waist and leg apertures for fitting the infant harness about the baby, the adjustment means comprising a strap length adjustment device.

5. The apparatus of claim 1 wherein the adult harness provides fabric shoulder straps, a one-piece back panel, and a waist strap configured with an adult waist aperture and two adult arm apertures for accepting an adult within the adult harness, wherein the one-piece back panel comprises an adult shoulder strap cinching means integral therewith, the shoulder strap cinching means enabled and positioned for raising and lowering the infant harness relative to the adult harness.

6. The apparatus or claim 5 further comprising means for adjustment of the adult waist and arm apertures for fitting the adult harness about the adult and for adjusting the height of the baby relative to the adult.

7. The apparatus of claim 1 wherein the infant harness provides fabric front, rear and crotch panels configured with an open waist aperture and two leg apertures for accepting a baby within the infant harness.

8. The apparatus of claim 7 wherein the infant harness provides a means for buoyancy within the front panel.

9. The apparatus of claim 7 further comprising means for adjustment of the baby waist and leg apertures for fitting the infant harness about the baby.

10. The apparatus of claim 1 wherein the adult harness provides fabric shoulder straps, a one-piece back panel, and a waist strap configured with an adult waist aperture and two adult arm apertures for accepting an adult within the adult harness.

11. The apparatus of claim 10 wherein the one-piece back panel comprises an adult shoulder strap cinching means integral therewith, the shoulder strap cinching means enabled and positioned for raising and lowering the infant harness relative to the adult harness.

12. The apparatus of claim 10 further comprising means for adjustment of the adult waist and arm apertures for fitting the adult harness about the adult and for adjusting the height of the baby relative to the adult.

13. The apparatus of claim 1 wherein the sliding engagement means provides frictional contact enabling positional horizontal setting of the baby harness with respect to the adult harness.

* * * * *